US005497174A

United States Patent [19]

Stephany et al.

[11] Patent Number: 5,497,174

[45] Date of Patent: Mar. 5, 1996

[54] VOLTAGE DROP CORRECTION FOR INK JET PRINTER

[75] Inventors: Joseph F. Stephany, Williamson; Juan J. Becerra, Webster; Thomas P. Courtney, Fairport; Gary A. Kneezel, Webster; Richard V. LaDonna, Fairport; Peter J. John, Rochester; Thomas E. Watrobski, Penfield; Joseph J. Wysocki, Webster, all of N.Y.

[73] Assignee: Xerox Corporation, Stamford, Conn.

[21] Appl. No.: 209,050

[22] Filed: Mar. 11, 1994

[51] Int. Cl.[6] ..... B41J 2/05

[52] U.S. Cl. ..... 347/13; 347/14; 347/189; 347/194

[58] Field of Search ..... 347/13, 12, 14, 347/57, 190, 188, 189, 194, 182

[56] References Cited

U.S. PATENT DOCUMENTS

| | | | |
|---|---|---|---|
| 4,345,262 | 8/1982 | Shirato et al. | 347/57 |
| 4,389,935 | 6/1983 | Arai | 347/190 X |
| 4,563,691 | 1/1986 | Noguchi | 347/190 |
| 4,639,741 | 1/1987 | Inoue | 347/182 |
| 4,875,056 | 10/1989 | Ono | 347/190 X |
| 4,980,702 | 12/1990 | Kneezel et al. | 347/17 |
| 5,036,337 | 7/1991 | Rezanka | 347/14 |
| 5,157,411 | 10/1992 | Takekoshi | 347/13 |
| 5,223,853 | 6/1993 | Wysocki et al. | 347/14 |

FOREIGN PATENT DOCUMENTS

| | | | |
|---|---|---|---|
| 404357036 | 12/1992 | Japan | B41J 2/015 |

*Primary Examiner*—Joseph W. Hartary
*Attorney, Agent, or Firm*—Oliff & Berridge

[57] ABSTRACT

An apparatus and method compensates for a voltage drop of electrical pulse signals selectively applied to a plurality of heater elements on a printhead of an ink jet printing device. A number of heater elements to be pulsed at a given time is determined and a time duration of each of the pulse signals is selected based on information including the determined number of heater elements to be pulsed. In another aspect, the position on the printhead of the heater elements to be pulsed is determined and the time duration of the pulse signals is selected further based on the determined position. By varying the time duration of the pulse signals applied to the heater elements, a voltage drop across the heater elements due to the number of heater elements simultaneously pulsed and/or the position of the heater elements on the printhead is compensated for, maintaining reliable jetting performance while minimizing the voltage by which operating printing voltage needs to exceed the threshold printing voltage.

16 Claims, 4 Drawing Sheets

VOLTAGE DROP CORRECTION FOR INK JET PRINTER

BACKGROUND OF THE INVENTION

1. Field of the Invention

This invention relates to ink jet printers and more particularly, to a method and apparatus for compensating for a voltage drop of pulse signals applied to heater elements of an ink jet printhead to enhance the quality of printing.

2. Description of Related Art

A thermal ink jet printhead selectively ejects droplets of ink from a plurality of drop ejectors to create a desired image on a copy surface. The printhead typically comprises an array of drop ejectors that convey ink to the copy surface. The printhead may move back and forth relative to the copy surface to print the image. Alternatively, the array may extend across the entire width of the copy surface. In either case, the copy surface moves perpendicularly relative to the linear array of the printhead. The ink drop ejectors typically comprise ink passageways, such as capillary channels, having nozzle ends and are connected to one or more ink supply manifolds. Each channel typically has a heater element for heating the ink. Ink from the manifold is retained within each channel until, in response to an appropriate signal, the ink in the channel is rapidly heated and vaporized by the heater element disposed within the channel. This rapid vaporization of some of the ink creates a bubble that causes a quantity of ink or droplet to be ejected through the nozzle to the copy surface. U.S. Pat. No. 4,774,530 to Hawkins shows the general configuration of a typical ink jet printhead. In order to enable high speed printing it is necessary to have multiple jets that are able to print simultaneously, as required by the pattern to be printed. For example, in a typical commercially available 128 jet printhead, up to 4 jets are fired at a time.

In conventional ink printing devices, the voltages applied across the heater elements are typically 10% over the "threshold" potential (the lowest voltage at which drops are ejected). However, if the voltage is set too high, the printhead degrades earlier due to kogation (ink residue) and results in heater failure.

Several prior art devices have attempted to control the temperature of the printhead to control the droplet and subsequent spot size.

For example, U.S. Pat. No. 4,980,702 to Kneezel et al. discloses a temperature control system that utilizes a control circuit that regulates heater operation to maintain the printhead in a desired operating range.

However, controlling the temperature of the printhead is difficult because to achieve a constant temperature range requires a large feedback time to sense the temperature, regulate the heater and check the regulated temperature.

To overcome the difficulties of directly controlling the temperature of the printhead, U.S. Pat. No. 5,223,853 to Wysocki et al., proposes selectively applying an electrical input signal having an amplitude and time duration to the heater elements to control the size of the ejected ink droplet.

It is further known that the size of a discharged droplet is determined by various controlling factors such as electrical energy quantity, as discussed in U.S. Pat. No. 4,345,262 to Shirato et al.

SUMMARY OF THE INVENTION

It has been found that variation of the voltage applied across individual heater elements of the printhead depends on how many heaters are simultaneously pulsed as well as the position of the pulsed heater element on the printhead. However, none of the prior art patents disclose a method or apparatus for compensating for a voltage drop across the heater elements depending on how many elements are pulsed simultaneously or the position on the printhead of the fired elements.

Accordingly, it is an object of this invention to provide voltage drop correction for the heater elements of an ink jet printer.

It is also an object of this invention to provide such voltage drop correction depending on the number of heater elements to be pulsed simultaneously.

It is also an object of this invention to provide such voltage drop correction depending on the position on the printhead of heater elements to be pulsed.

It is also an object of this invention to control the droplet size of ejected ink in an ink jet printhead at elevated temperatures.

To achieve the above and other objects, this invention includes a method of compensating for a voltage drop of electrical pulse signals selectively applied to a plurality of heater elements on a printhead of an ink jet printing device. The method comprises the steps of determining a number of the plurality of heater elements to be fired, and selecting a time duration of each of the pulse signals based on information including the determined number of heater elements to be pulsed. In another aspect, the method further comprises the steps of determining a position on the printhead of each of the heater elements to be pulsed and selecting the time duration of the pulse signals further based on the determined position of the heater elements to be pulsed. The method compensates for a voltage drop of electrical pulse signals applied to the heater elements by increasing the time duration of the pulse signals as the determined number of heater elements to be pulsed increases and increasing the time duration of the pulse signals as the position of the heater elements to be fired becomes closer to the center of the printhead.

This invention also includes an apparatus for carrying out the above-described methods.

BRIEF DESCRIPTION OF THE DRAWINGS

These and other aspects and advantages will become apparent from the following detailed description of preferred embodiments when taken in conjunction with the accompanying drawings, in which like reference numerals represent like elements.

DETAILED DESCRIPTION OF PREFERRED EMBODIMENTS

Figure 1:
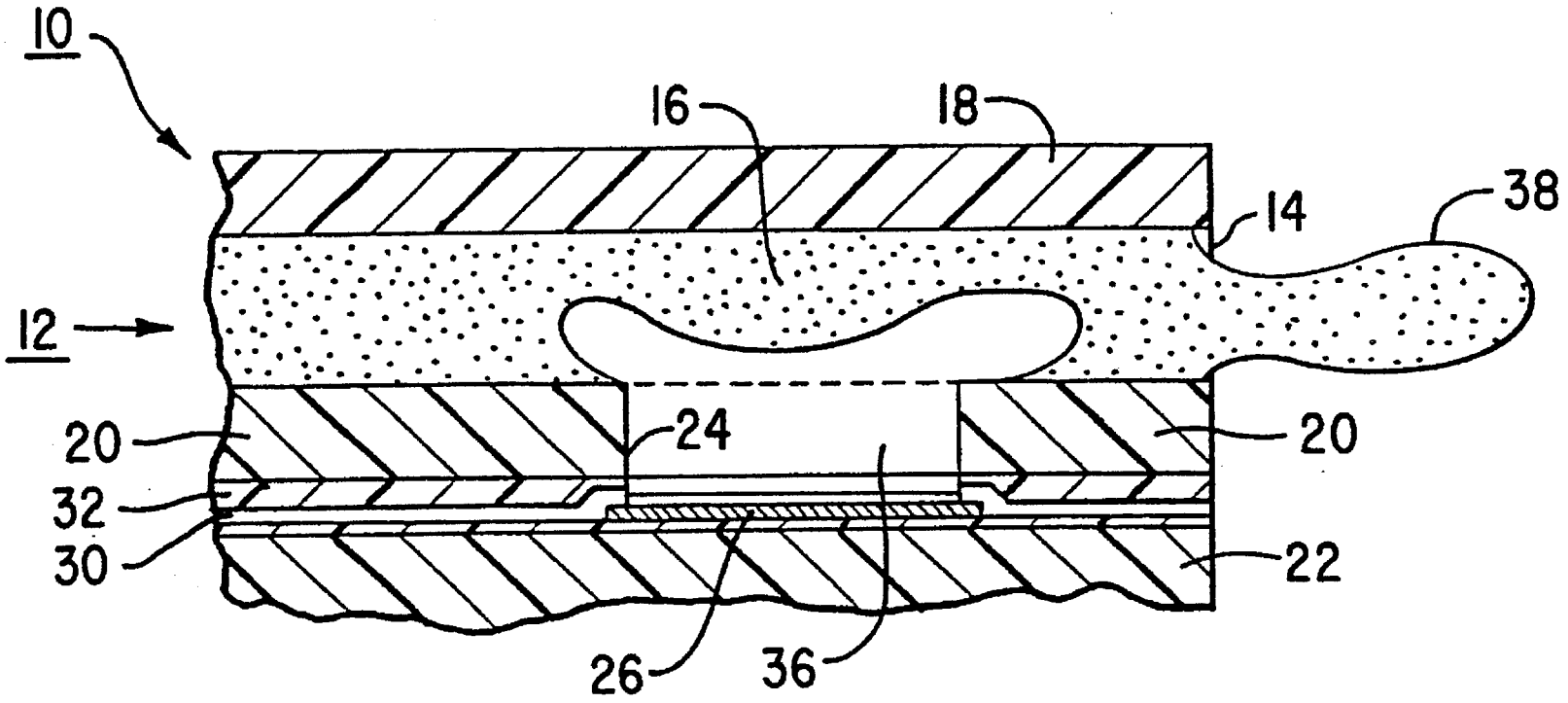
FIG. 1 is a sectional elevational view of a nozzle of an ink jet printhead.

For purposes of background information on generally controlling spot size with electrical input signals, U.S. Pat.

No. 5,223,853 of Wysocki et al. is hereby incorporated into this specification by reference.

Variation of the voltage across heater elements of an ink jet printhead occurs due to various factors, such as parasitic resistances in the printhead and external circuitry, the number of heaters simultaneously pulsed at any given time and the position of the heater element to be fired on the printhead. In conventional ink jet printers, such voltage drops across a given heater element are typically compensated for by producing pulses to individual heater elements that have a potential of approximately 10% over the "threshold" potential (the potential at which an ink drop is first produced). This ensures that each heater element will reach sufficient temperature for drop ejection, regardless of heater element position or the number of jets fired simultaneously.

The optimal voltage applied across the heater for printing depends on heater resistance, driver transistor on-resistance, pulse width, as well as variations due to the number and position of the heater elements to be fired. Further, variations in heater and transistor resistances make it necessary to set the power supply at a sufficiently high voltage that all jets will print reliably. Too high a voltage setting leads to printhead degradation through kogation (ink residue) and leads to heater element failure. At higher voltages, the heater elements heat up more quickly. Manifestation of the voltage variation due to heater element position on the printhead or the number of heater elements fired at a given time is seen when the printhead is operated too close to the threshold voltage. This may lead to the situation where a single heater element may be fired reliably, but when a plurality of heater elements are pulsed, they fail to fire. Additionally, a single heater element near the edge of the printhead may fire reliably, but fail to fire if located near the center of the printhead. This is because there is a greater voltage drop across parasitic resistances, and correspondingly less across the heater elements for the cases of multiple heater elements fired, or for heater elements located closer to the center of the printhead.

It has been shown that thermal ink jet performance can be considerably improved by the use of variable pulse width. This makes possible a considerable increase in reliability of operation by extending the temperature operating range of the printhead cartridge. It further regulates spot size and eliminates ingestion of air into the ink channels.

To solve the above problems, the present invention provides a method and apparatus that increases the pulse width as the number of heater elements simultaneously pulsed increases or as the heater elements fired are more central on the printhead. The present invention uses at least one lookup table which is selected by the number and/or position of heater elements to be pulsed at a given time. Thus, the pulse width is controlled by the number and/or position of heater elements to be pulsed. As a result, heater elements which see a lower voltage due to their position on the printhead or the number of jets fired, still reach the required temperature for reliable jetting, because the pulse width is appropriately modified. Additionally, the system can modify the pulse width in accordance with printhead temperature, as will be explained below.

As set forth in the preceding background discussion, the operating characteristics of a thermal ink jet printer are affected by variations in the temperature of the printhead. If the printhead temperature is too low, print quality defects due to erratic jetting, poor character definition, and low print density may result; if the temperature is too high, print quality defects due to resolution loss, inadequate drying or erratic operation can occur. The temperature range in which erratic operation may occur is relatively large (i.e., 10°–70° Celsius (C.)). Within this large temperature range is a smaller range that provides good print quality. This smaller range may be affected by variations in printhead and ink design, but experience has shown that this smaller range is generally 10°–20° C. As printhead temperature moves outside this smaller temperature range, print quality degrades. In particular, as the printhead temperature falls below the minimum in the smaller range, print quality suffers from poorly-filled characters and low print density. As the printhead temperature rises above the maximum in the smaller range, print quality suffers from line broadening and loss of print resolution. In the case of color printing, an even move restricted range of temperature is needed to prevent colors from varying from their intended hue. Since printing is effected by applying electrical heating pulses to the selected heater elements, the act of printing results in increases in printhead temperature. Continuous high density printing can therefore result in printhead temperature increasing beyond the acceptable range.

FIG. 1 shows a sectional elevational view of a drop ejector of an ink jet printhead, one of a plurality of such ejectors which is found in one version of an ink jet printhead. Typically, such ejectors are sized and arranged in linear arrays of 300 ejectors per inch. As will be used herein, a silicon member having a plurality of channels for drop ejectors defined therein, typically 128 ejectors, is known as a "die module" or "chip". A thermal ink-jet apparatus may have a single chip which extends the full width of a copy sheet, on which an image is to be printed such as 8½ inches or more, although many systems comprise smaller chips which are moved across a copy sheet in the manner of a typewriter, or which are abutted across the entire substrate width to form the full-width printhead. In designs with multiple chips, each chip may include its own ink supply manifold, or multiple chips may share a single common ink supply manifold.

Each ejector, generally indicated as 10, includes a capillary channel 12 which terminates in an orifice 14. The channel 12 regularly holds a quantity of ink 16 which is maintained within the capillary channel 12 until such time as a droplet of ink is to be ejected. Each of a plurality of capillary channels 12 are maintained with a supply of ink from an ink supply manifold (not shown). The channel 12 is typically defined by an abutment of several layers. In the ejector shown in FIG. 1, the main portion of channel 12 is defined by a groove anisotropically etched in an upper substrate 18, which is made of a crystalline silicon. The upper substrate 18 abuts a thick-film layer 20, which in turn abuts a lower substrate 22.

Sandwiched between thick film layer 20 and lower substrate 22 are electrical elements which cause the ejection of droplets of ink from the capillary channel 12. Within a recess 24 formed by an opening in the thick film layer 20 is a heating element 26. The heating element 26 is typically protected by a protective layer made of, for example, a tantalum layer having a thickness of about one micron. The heating element 26 is electrically connected to an addressing electrode 30. Each of the large number of nozzles 10 in a printhead will have its own heating element 26 and individual addressing electrode 30 to be controlled selectively by control circuitry, as will be explained in more detail below. The addressing electrode 30 is typically protected by a passivation layer 32.

When an electrical signal is applied to the addressing electrode 30, energizing the heating element 26, the liquid ink immediately adjacent the element 26 is rapidly heated to the point of vaporization, creating a bubble 36 of vaporized ink. The force of the expanding bubble 36 causes a droplet 38 of ink to be emitted from the orifice 14 onto the surface of a copy sheet. The "copy sheet" is the surface on which the mark is to be made by the droplet, and may be, for example, a sheet of paper or a transparency.

Figure 2:
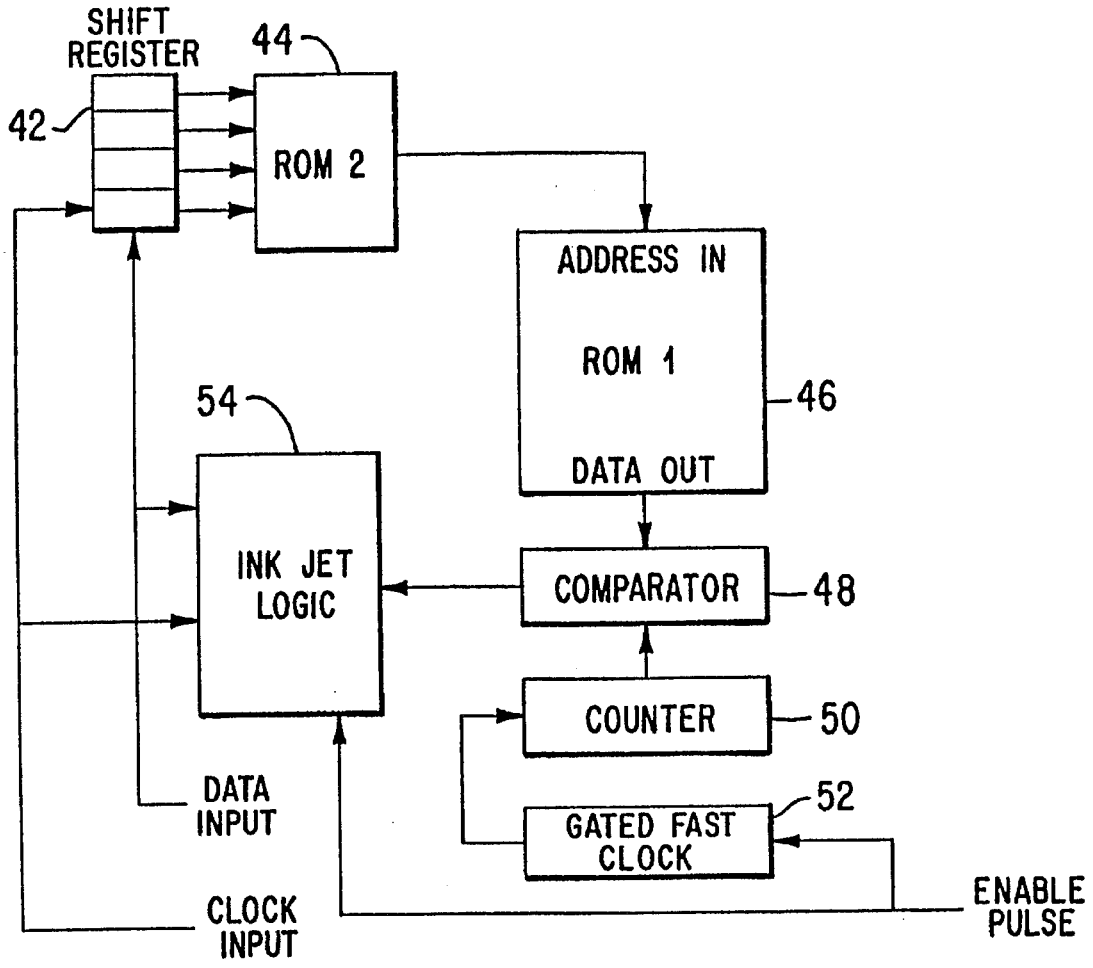
FIG. 2 is a systems diagram illustrating one embodiment having voltage drop correction for the number of heater elements to be pulsed.

FIG. 2 shows a system diagram of one embodiment of the present invention. In this embodiment, the voltage drop caused by the current flowing in the feed buses to the heater elements 26 on a printhead is compensated for based on a determined number of heater elements 26 to be pulsed at a given time. Ink jet logic 54 is contained on an ink jet printhead (not shown) which selectively supplies pulses to individual heater elements 26 on the printhead in accordance with data input from a control system (not shown). The data is also input to shift register 42. The data input to the shift register indicates which heater elements are to be fired add is fed sequentially to shift register 42. In this particular embodiment, zero to four heater elements 26 contained in one of thirty-two groups of heater elements (128 total heater elements) contained on the printhead may be fired at any given time. The four bits of data output from shift register 42 is routed to ROM2 44 as an address. The data output from ROM2 44 is a two-bit word representing the number of heater elements 26 to be fired. In this case 00 is used for no heater elements 26 and for any one of the four heater elements 26, 01 is used for any two heater elements 26, 10 is used for any three heater elements 26 and 11 is used for all four heater elements 26 to be fired at a given time.

The data output from ROM2 44 is used as an input address for lookup tables contained in ROM1 46. ROM1 46 has data at each address containing a coded pulse width for each address. The output from ROM1 46 is the pulse width to be applied to the heater elements 26 to be fired. In this particular embodiment, the pulse width is modulated to increments of one-eighth of a microsecond. The output from ROM1 is routed to comparator 48. An enable pulse from the control system starts a gated fast clock 52, which commences counting of counter 50. In this embodiment, the fast clock increments the counter every ⅛ microsecond. The output of the counter 50 is also routed to comparator 48. Comparator 48 is on whenever the coded pulse width output from ROM1 46 is greater than the count output from counter 50. When the counter 50 counts to the point where it has an output equal to the output of ROM1 46, the comparator shuts off its output. This output from comparator 48 thus has a pulse width which is relative to the number of heater elements to be fired. The pulse is then output to ink jet logic 54. Ink jet logic 54 directs the pulse having the selected pulse width to the appropriate heater elements. This process is repeated thirty-two times (once for each of the thirty-two groups of heater elements) prior to cycling again through firing the heaters as the printhead moves relative to the print medium. Repeating the process thirty-two times takes approximately 200 microseconds in the preferred embodiment. The invention could be modified so that any number of heater elements contained on the printhead could be pulsed at a given time, and the system could compensate for the number of heater elements to be pulsed.

Figure 3:
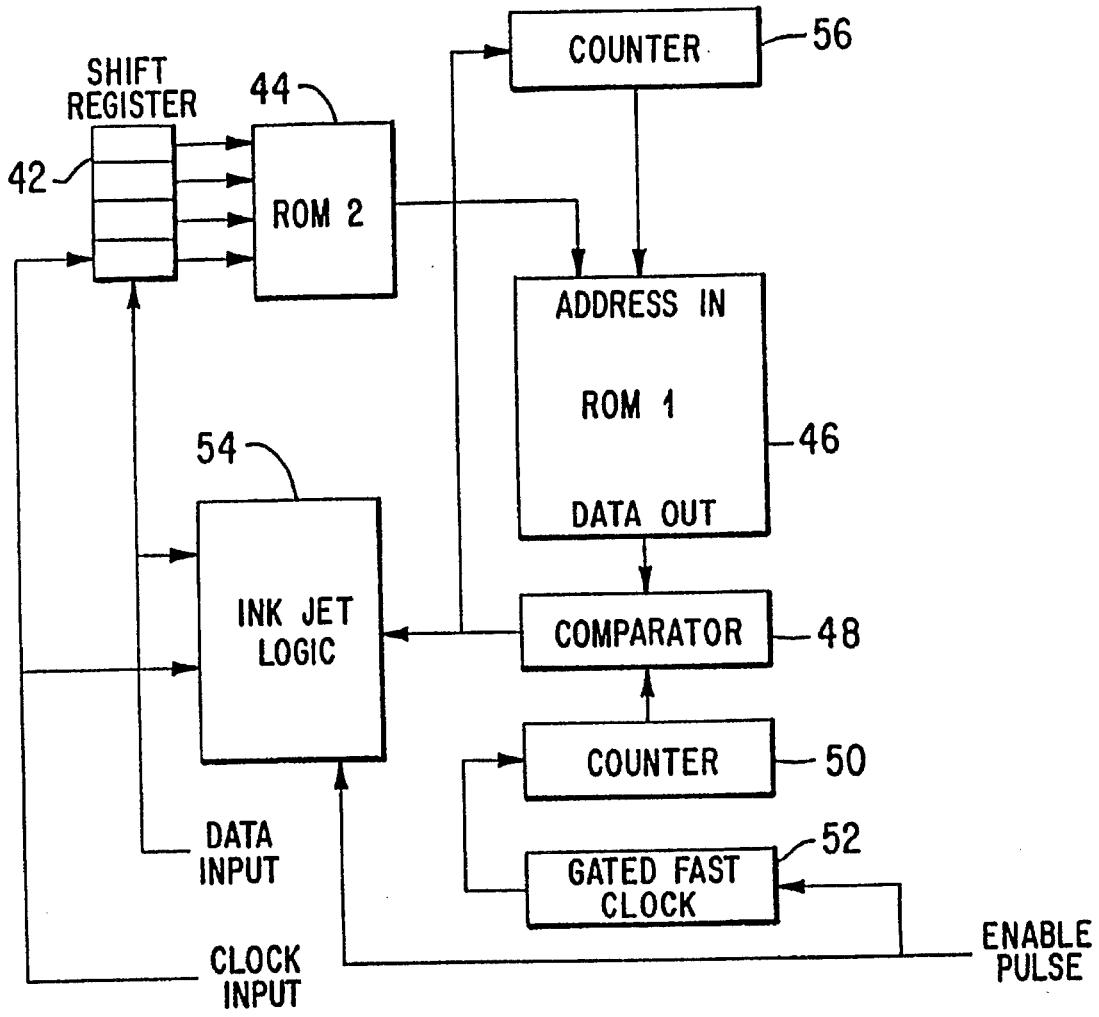
FIG. 3 is a systems diagram illustrating another embodiment having voltage drop correction for both the number of heater elements to be pulsed and the position on the printhead of the heater elements to be pulsed.

FIG. 3 shows a system diagram of a second embodiment of the present invention, which compensates for a voltage drop across individual heater elements 26 based on the number of heater elements to be fired, as well as for the position of the heater elements 26 on the printhead. The circuitry contained in FIG. 3 that is identical to that of FIG. 2 operates the same and will not be further explained herein. To compensate for a voltage drop across the heater elements 26 due to their position on the printhead, a counter 56 is used. In this particular embodiment, counter 56 counts from 0 to 31. The count of counter 56 is indicative of one of the thirty-two groups of four heater elements contained on the printhead. Each time comparator 48 outputs a pulse, which is also fed to counter 56, counter 56 advances its count by one. The count of counter 56 is output to ROM1 46 and is used as part of the address. Thus, the address of ROM1 46 is selected by data indicative of the number of heater elements to be fired, as well as the position of the heater elements to be fired on the printhead. The system of the present invention could be easily modified so as to apply finer control so that each of the individual heater elements could be pulsed with pulse widths individually modified as opposed to the present system which selects the pulse widths for each of the thirty-two groups of four heater elements that may be fired at any given time.

It will be apparent that numerous look-up tables, each reflective of a particular combination of printing conditions, can be made available to the user from ROM1 46. The user may choose not only a desired spot size, but also enter in data relating to, for example, a particular type of ink being used or a particular type of copy sheet. It is likely that different types of ink (of different colors, for example) will have different temperature sensitive characteristics. In addition, in a color printer, which creates different colors by combining various amounts of cyan, yellow, magenta, or black ink, a user-adjustable spot size control input can be used to achieve the desired color balance. Another printing parameter which may have an effect on the quality of the printed image is the type of copy sheet being used, such as plain paper or a transparency. When the present invention is used for printing on transparencies, it has been found that selection of a larger than normal spot size is advantageous in order to achieve the desired saturation of ink without a penalty in printing throughput. The actual duration may be obtained through empirical data derived from experimentation with the actual apparatus.

With the control system of the present invention, it is possible to redetermine the appropriate duration of the heater pulse after every cycle of ejection of ink from the ejectors, that is, substantially continuously. In a practical situation, the actuation of the heating element in the ejectors, or even neighboring ejectors, may cause the printhead in general, and the ink within the individual channels, to heat up to such an extent that a new duration will be required in the very next cycle. The system of the present invention is versatile enough to respond quickly to such temperature changes. The system may be adapted to sense the temperature of the ink following every cycle of emitting ink, or following some predetermined number of cycles, which may be desirable to accommodate, for example, the time-lag of any temperature-sensitive device, or at convenient breaks in the operation of the printhead, as when the printhead changes direction between printing swaths across a page.

Figure 4:
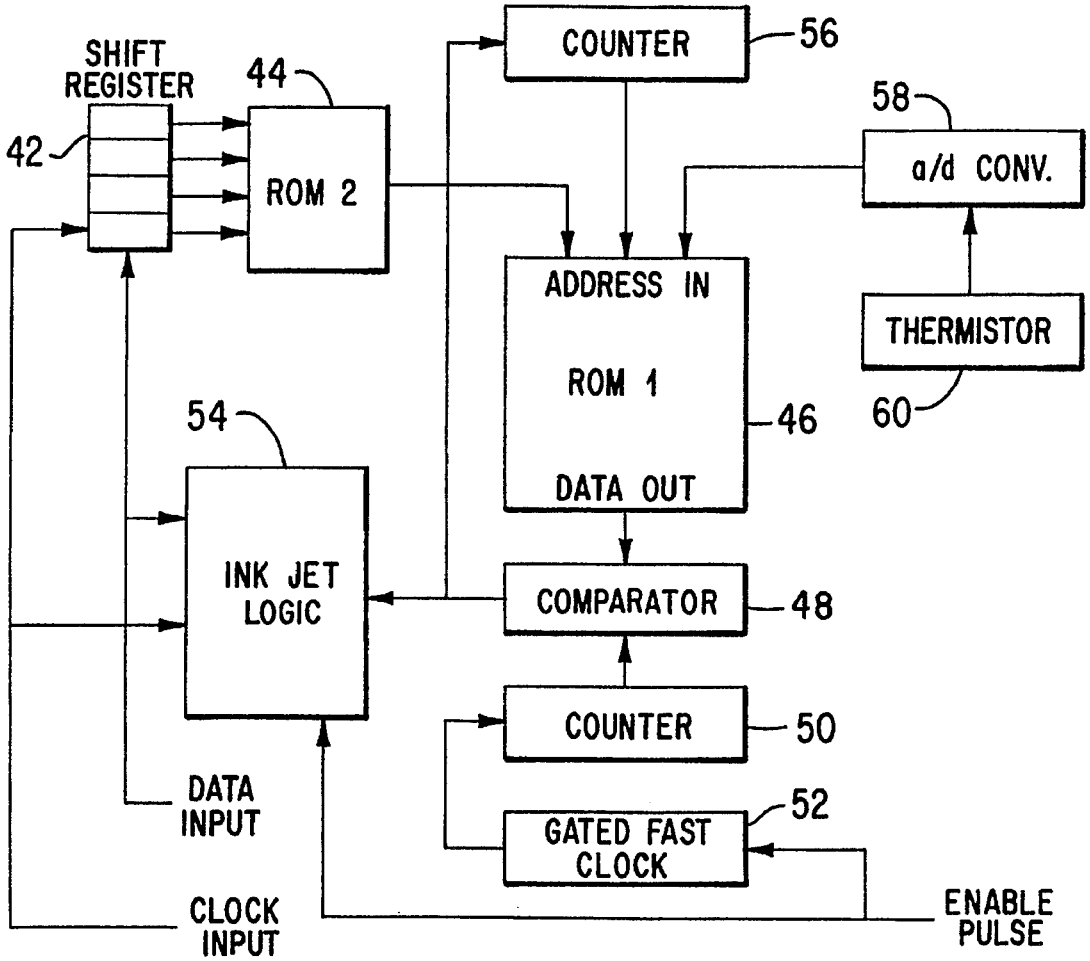
FIG. 4 is a systems diagram illustrating another embodiment having voltage drop correction for the number of heater elements to be pulsed, the position of the heater elements to be pulsed and the temperature of the ink.

FIG. 4 shows a system diagram which compensates for a voltage drop of pulse signals applied to heater elements 26 by compensating for the number of heater elements 26 to be fired, the position on the printhead of the heater elements 26 to be fired as well as the temperature of the printhead at any time. Thermistor 60, which can be located on the printhead, measures the temperature of the printhead. The measured temperature is fed to analog-to-digital converter 58, which converts the measured temperature into digital data. The output of the analog-to-digital converter is fed to ROM1 46. Thus, ROM1 46 selects an address based on data indicative of the number of heater elements 26 to be fired, the position on the printhead of the heater elements 26 to be fired and the measured temperature of the printhead at any given time. The rest of the circuitry shown in FIG. 4 functions identically with that shown in FIG. 3, and will not be further explained herein. With the use of the analog-to-digital converter 58 and thermistor 60, the pulse width is thus further selected based on the measured temperature of the printhead. The system of the present invention will select a shorter pulse width as the temperature of the printhead rises, because not as much energy will be necessary to produce an ink drop of constant size.

The invention has been described with reference to preferred embodiments thereof, which are intended to be illustrative and not limiting. Many modifications and variations will be apparent from the foregoing description of the invention, and all such modifications are intended to be within the scope of the present invention. Accordingly, variations of the invention can be made without departing from the spirit and scope of the present invention, as defined in the following claims.

What is claimed is:

1. An apparatus for compensating for a voltage drop of electrical pulse signals selectively applied to a plurality of heater elements on a printhead of an ink jet printing device, comprising:

first determining means for determining a position on the printhead of each of said plurality of heater elements to be pulsed; and selecting means for selecting a time duration of each of the pulse signals based on the determined position of a corresponding one of the heater elements to be pulsed, wherein a gradient of the time duration of the pulse signals increases as the position of the heater elements is closer to a center of the plurality of heater elements.

2. The apparatus of claim 1, wherein the selecting means increases the time duration of each of the pulse signals as the position on said printing device of the corresponding one said heater elements to be pulsed is closer to the center of said plurality of heater elements.

3. The apparatus of claim 1, wherein the selecting means includes at least one electronic look-up table.

4. The apparatus of claim 3, wherein the selecting means further includes a comparator connected to said at least one electronic look-up table and a counter connected to said comparator, the comparator comparing a signal output from said at least one look-up table and a signal from said counter to produce a signal having the selected time duration.

5. The apparatus of claim 1, further comprising means for sensing a temperature of ink used in said ink jet printing device.

6. The apparatus of claim 1, wherein the selecting means selects the time duration based on the sensed temperature of said ink.

7. The apparatus of claim 1, further comprising second determining means for determining a number of the plurality of heater elements to be pulsed.

8. The apparatus of claim 7, wherein the selecting means selects a time duration of each of the pulse signals based on the determined number of heater elements to be pulsed.

9. The apparatus of claim 8, wherein the selecting means selects an increased duration of each of the pulse signals as the determined number of heater elements to be pulsed increases.

10. The apparatus of claim 7, wherein the second determining means comprises:

a shift register having sequential input data indicative of which of said heater elements are to be pulsed and outputting parallel data; and a ROM connected to said shift register that receives said parallel data as an address and outputs data indicative of how many heater elements are to be pulsed.

11. A method of compensating for a voltage drop of electrical pulse signals selectively applied to a plurality of heater elements on a printhead of an ink jet printing device, comprising the steps of:

determining a position on the printhead of each of the plurality of heater elements to be pulsed;

selecting a time duration of each of the pulse signals based on information including the determined position of a corresponding one of the heater elements to be pulsed, wherein a gradient of the time duration of the pulse signals increases as the position of the heater elements is closer to a center of the printhead.

12. The method of claim 11, wherein the step of selecting a time duration of each of the pulse signals includes the steps of:

inputting information including the determined position of the heater elements to be pulsed to at least one electronic look-up table;

accessing an address in said at least one electronic look-up table for each of said heater elements to be pulsed based on said information;

inputting data contained at said address to a comparator;

comparing said data to a signal output from a counter;

starting a pulse signal output from said comparator when the data is greater than the signal from the counter; and ending the pulse signal output from said comparator when the data equals the signal from the counter, producing a signal having the selected time duration.

13. The method of claim 11, further comprising the step of sensing a temperature of ink used in said ink jet printing device.

14. The method of claim 13, wherein the information further includes the temperature sensed in the temperature sensing step.

15. The method of claim 11, further comprising the steps of:

determining a number of the plurality of heater elements to be pulsed; and selecting the time duration of each of the pulse signals further based on the determined number of heater elements to be pulsed.

16. The method of claim 15, wherein the step of selecting a time duration of each of the pulse signals includes the steps of:

inputting information including the determined position and the number of heater elements to be pulsed to at least one electronic look-up table;

accessing an address in said at least one electronic look-up table based on said information;

inputting data contained at said address to a comparator;

comparing said data to a signal output from a counter;

starting a pulse signal output from said comparator when the data is greater than the signal from the counter; and ending the pulse signal output from said comparator when the data equals the signal from the counter, producing a signal having the selector time duration.

* * * * *